United States Patent [19]

Brauer et al.

[11] 3,942,350

[45] Mar. 9, 1976

[54] ROLLING MILL TRAIN FOR THE PRODUCTION OF WIRE

[75] Inventors: Hans Brauer, Leichlingen; Paul Duepper, Dusseldorf-Oberkassel, both of Germany

[73] Assignee: Friedrich Kocks, Dusseldorf, Germany

[22] Filed: May 15, 1975

[21] Appl. No.: 577,857

Related U.S. Application Data

[63] Continuation of Ser. No. 459,215, April 8, 1974, abandoned.

[52] U.S. Cl. ..... 72/228

[51] Int. Cl.[2] ..... B21B 1/18

[58] Field of Search ..... 72/227, 228, 234, 202

[56] References Cited

UNITED STATES PATENTS

| | | | |
|---|---|---|---|
| 351,840 | 11/1886 | Lenox | 72/228 |
| 407,177 | 7/1889 | Daniels | 72/228 |
| 429,425 | 6/1890 | Daniels | 72/202 |
| 3,625,043 | 12/1971 | Neamann et al. | 72/228 X |

*Primary Examiner*—Milton S. Mehr

*Attorney, Agent, or Firm*—Toren, McGeady and Stanger

[57] ABSTRACT

In a rolling mill train for producing wire, a billet is passed from a furnace to a single-core roughing train and then into a distributor for directing the rolled material into a number of heat-insulated storage channels. At the opposite end of each channel an intermediate train is arranged immediately followed in rectilinear alignment by a finishing train so that the rolled material passes in a straight line directly from the storage channel through the intermediate and finishing train for forming the finished wire.

1 Claim, 1 Drawing Figure

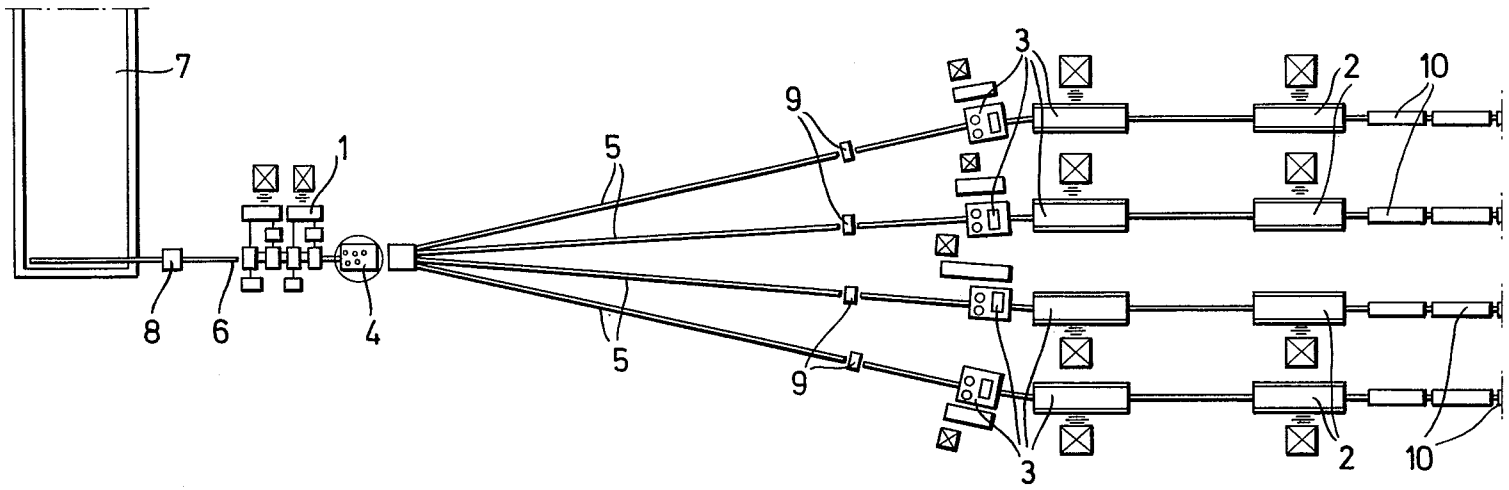
10
2
3
9
5
4
1
6
8
7

ROLLING MILL TRAIN FOR THE PRODUCTION OF WIRE

This is a Continuation of application Ser. No. 459,215, filed Apr. 8, 1974, now abandoned.

SUMMARY OF THE INVENTION

The present invention is directed to a rolling mill train for the production of wire from regular and refined steel, with the train consisting of a single-core roughing train formed of several groups of roll stands arranged in series, a device for distributing the rolled material from the roughing train to a number of storage channels and then from each storage channel into an intermediate train immediately followed in rectilinear alignment by a finishing train.

Known rolling mill trains of this general type serve to meet the increasing demand for greater wire rolling mill capacity by, on one hand, increasing the weight and cross section of the billets, and on the other hand, by operating the roughing train and the following trains at optimum outlet speed.

Since the output of even single-core roughing trains provided with a relatively small number of stands suffice, with proper utilization, to supply a plurality of following intermediate and finishing trains with the material to be rolled, even if they are operated at a relatively high inlet speed, interposed distributing and storing devices serve to afford the necessary equalization between the output of the roughing train and the operating capacity of the following trains.

In modern wire rolling mills, storage devices as disclosed in DOS Pat. No. 1,652,566 are used which employ two-part looping tables of great length which receive alternately rolled material issuing from a roughing train over a switch so that the rolled material is fed through the stands of an intermediate train and then moves through bypasses, changing direction repeatedly, before entering one of two concurrently operated finishing trains. In another wire rolling mill disclosed in Luxembourg Pat. No. 93,739, the storage devices consist of four juxtaposed coiling or winding furnaces which receive the rolled material issuing from a roughing train alternately over a bypass and loop-thrower with the material being transferred, after the reversal of its direction of rotation, over the loop-thrower and an additional bypass to a finishing train.

Both the looping tables and the coiling furnaces require the transformation of the billets entering the roughing train into bars with a relatively small cross section and a correspondingly great length, and such transformation necessitates in turn, apart from a greater number of stands in the roughing train, special measures and devices for influencing the intermediate material by means of heat, so that a rough material of uniform temperature over its entire length can be fed to the intermediate and finishing trains. Looping tables, coiling furnaces and bypasses render the processing of high alloy, brittle steel either more difficult or prevent it altogether.

The present invention is directed to the provision of a rolling mill train for producing wire, which permits, with reduced expenditure of space and operating means, the optimum utilization of the rolling speeds in both the roughing train and the following train, for the single-core straight rolling of large billets into wire of commercial cross section and corresponding lengths.

In accordance with the present invention, a rolling mill train includes a storage device consisting of a plurality of rectilinear storage channels each of which extends from a distributor device arranged at the outlet from a roughing train to an intermediate train with the intermediate train followed directly by a finishing train which is in rectilinear alignment with it. The billet directed into the roughing train passes as a straight solid bar through the storage channel for subsequent passage along a rectilinear path through the intermediate train and finishing train for forming finished wire.

The straight or rectilinear rolling of billets into wire, which is made possible in a rolling mill train of the present invention, renders the use of large grouping tables and bypasses between stands of the intermediate train and also coiling furnaces and associated loop-throwers as unnecessary. Further, it permits the working of high alloy steel without sacrificing the utilization of existing stands and without other considerations. Because of the relatively large cross section and small lengths of the rolled material, passing from the roughing train, which is to be stored, a particularly favorable heat balance is achieved with the minimum expenditure of means for obtaining temperature equalization over the length of the stored material. In addition, high rolling speeds can be used even in the roughing train, which consists of a relatively small number of stands. By using a relatively small number of stands, the heat loss in the rolled material is kept low and overheating of the rolls is prevented. Furthermore, a particularly effective and economical pressurized water descaling device can be employed in the path of the billets passing into the roughing train. This device prevents reactions occurring in the following trains based on the operation of the roughing train. These problems are kept to a minimum, particularly if an automatic signalling device is used for delivering billets from the furnace to the roughing train based on the readiness of the following trains to process the rolled material. Such a signalling device permits an arbitrary limitation on the rolling mill operation to a smaller number of intermediate and finishing trains with a correspondingly reduced utilization of the roughing train, but without the accumulation of stored rolled material which requires heat treatment.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

In the drawing:

The drawing is a schematic illustration of a rolling mill train embodying the present invention.

DETAILED DESCRIPTION OF THE INVENTION

As illustrated in the drawing, the rolling mill train consists of a roughing train 1, four identical finishing trains 2 arranged in parallel side-by-side relation with an intermediate train 3 located immediately ahead of each of the finishing trains. A distributor switch 4 is located at the outlet from the roughing train 1 and four rectilinear storage channels 5 extend from the distributor switch, each to one of the intermediate trains.

In the path of a billet 6 moving from a furnace 7 to the roughing train 1, there is a pressurized water descaling device 8. A pair of rollers 9 is located in each storage channel 5 so that the rolled material from the roughing train 1 can be braked, as desired, to the inlet speed of the following intermediate train or can be stopped temporarily for subsequent introduction into the inlet stand of the intermediate train.

The storage channels 5 are heat-insulated and can be provided with a regulable heating system. Storage channels which are formed of well insulated and preheated pipes generally afford a sufficient heat equalization over the lengths of the rolled material. Accordingly, additional heating by the regulable heating system can be limited to the parts of the storage channels immediately adjacent the intermediate trains or the additional heating can be eliminated altogether. Water cooling zones 10 and loop throwers, not shown, which are connected over driving apparatus and air cooling zones to loop collecting and binding machines are usually arranged downstream from the outlets of the finishing trains 2.

In the embodiment shown in the drawings, the roughing train 1 consists of four dual stands arranged in H-V arrangement, that is, with the roll axes displaced relative to each other by 90°, and with the roll axis inclined by 45° toward the central vertical rolling plane. The roughing train is arranged to transform square billets with an edge distance of about 140mm to square bars with an edge distance of about 85mm.

In the intermediate trains 3, the rolled bars are roughed down in two H-V dual stands and in 10 three-roll stands so that they are drawn into hexagonal bars which are processed in the following finishing trains 2 to round wires of about 0.5mm diameter. The intermediate and finishing trains can be operated continuously with outlet speeds up to 50m/s and more.

Though the use of several separately driven single-core intermediate and finishing trains is preferred, because of the reduced effects on operating troubles and because of the twist-free rolling, the present invention does not exclude the possible adaptation of several parallel storage channels to the inlet passes of multi-wire, intermediate and finishing trains. In such an arrangement, the storage channels arranged close together can be combined into a single storage conduit with guides for the individual bars.

While a specific embodiment of the invention has been shown and described in detail to illustrate the application of the inventive principles, it will be understood that the invention may be embodied otherwise without departing from such principles.

What is claimed is:

1. Rolling mill train for use in the production of wire from billets of regular and refined steels, comprising a single-core roughing train arranged to receive a square billet of approximately 140 mm on a side from a billet furnce and to transform the billet into a square bar of about 85 mm on a side as it moves along a horizontal path, a plurality of single-core finishing trains spaced from said roughing train and said finishing trains arranged in parallel relationship and arranged to operate at an outlet speed of about 50 m/s, an intermediate train for each said finishing train located between said finishing train and said roughing train and arranged to operate at the same outlet speed as said finishing train, and means for distributing rolled material from said roughing train to said intermediate trains and for storing the rolled material which exceeds the capacity of said intermediate and finishing trains, wherein the improvement comprises that said means includes a distributor member located at the outlet from said roughing train and a plurality of rectilinear storage channels each associated with one of said intermediate trains and extending between said distributor member and its associated said intermediate train, at least one of said channels being spaced at an angle to said roughing train and to said intermediate train with which it is associated and adjacent said channels being spaced apart at an acute angle to one another, each said channel forming a heat insulated and heatable closed passage throughout the length thereof, each said intermediate train being arranged in a straight line and located immediately adjacent to and in rectilinear alignment with said finishing train with which it is associated so that the rolled material from each said storage channel can be fed through the associated said intermediate train and finishing train for forming finished wires, said distributor member being displaceable about a vertical axis for alignment with each of said storage channels for feeding the bar issuing from said roughing train into a selected one of said storage channels, and a pair of drive rollers located in each said storage channel in the path of the rolled material passing therethrough for providing a braking effect on the rolled material.

* * * * *